US010813844B2

(12) United States Patent
Mangione

(10) Patent No.: US 10,813,844 B2
(45) Date of Patent: Oct. 27, 2020

(54) HYDRATION APPARATUS AND SYSTEM

(71) Applicant: Medical Hydration Solutions LLC, La Quinta, CA (US)

(72) Inventor: Anthony Mangione, La Quinta, CA (US)

(73) Assignee: MEDICAL HYDRATION SOLUTIONS LLC, La Quinta, CA (US)

( * ) Notice: Subject to any disclaimer, the term of this patent is extended or adjusted under 35 U.S.C. 154(b) by 0 days.

(21) Appl. No.: 16/270,287

(22) Filed: Feb. 7, 2019

(65) Prior Publication Data

US 2020/0253831 A1 Aug. 13, 2020

(51) Int. Cl.
*A61J 15/00* (2006.01)

(52) U.S. Cl.
CPC ..... *A61J 15/0003* (2013.01); *A61J 15/0092* (2013.01)

(58) Field of Classification Search
CPC ..... A61J 15/0003; A61J 15/0092
See application file for complete search history.

(56) References Cited

U.S. PATENT DOCUMENTS 2,756,740 A * 7/1956 Deane ..... A61J 15/0011 604/77
3,173,566 A * 3/1965 Talbert ..... B65D 77/283 215/229
3,258,175 A * 6/1966 Taylor ..... G01F 11/025 222/380
3,485,419 A * 12/1969 Taylor ..... G01F 15/005 222/340
4,350,299 A * 9/1982 Stephenson ..... B65D 83/207 222/402.14
4,420,097 A * 12/1983 Motsenbocker ..... A45F 3/16 222/131
4,526,298 A * 7/1985 Boxer ..... A45F 3/16 222/130
4,629,098 A * 12/1986 Eger ..... A45F 3/16 138/115
4,921,141 A * 5/1990 Branum ..... A42B 1/24 222/146.6
5,029,719 A * 7/1991 Solomon ..... A47G 19/2266 215/229
5,167,354 A * 12/1992 Cohanfard ..... A45F 3/16 215/229
5,295,609 A * 3/1994 Robbins, III ..... A47G 19/2266 215/229

(Continued)

*Primary Examiner* — Frederick C Nicolas
(74) *Attorney, Agent, or Firm* — Winthrop & Weinstine, P.A.; Nadeem W. Schwen

(57) ABSTRACT

Systems and devices for providing readily accessible and unassisted oral hydration to a patient or other individual. A hydration system of the present disclosure may include a container for holding a quantity of liquid, a hydration tube extending from the container, and a hydration control valve through which a user may access the liquid by pushing or pressing on a lever. The hydration control valve may be, or be similar to, a pinch valve or bite valve arranged across a tube, such that by opening the valve, water may be permitted to flow through the tube. The valve may be arranged within a valve casing having a hydration tube coupling portion and a mouthpiece.

18 Claims, 10 Drawing Sheets

(56) References Cited

U.S. PATENT DOCUMENTS 5,478,015 A * 12/1995 Black ..... B05B 9/0877 222/175
5,509,551 A * 4/1996 Terrell, II ..... A47G 19/2266 215/229
5,662,268 A * 9/1997 Katzenberger ..... A47G 19/2266 239/154
6,082,589 A * 7/2000 Ash ..... B67D 1/04 222/146.6
6,227,403 B1 * 5/2001 Kim ..... B65D 77/28 215/388
6,296,154 B1 * 10/2001 Shanklin ..... B05B 1/3026 222/321.9
6,419,485 B1 * 7/2002 Pond ..... A61C 1/0084 433/80
6,427,779 B1 * 8/2002 Richman ..... A62C 3/10 169/30
6,550,493 B2 * 4/2003 Williamson ..... A47G 21/185 137/494
6,554,023 B2 * 4/2003 Danby ..... B65D 47/248 137/510
6,666,360 B1 * 12/2003 Swank ..... A45F 3/20 222/175
6,863,261 B2 * 3/2005 Swan ..... B29C 45/0055 251/356
7,497,186 B2 * 3/2009 Dorton ..... A01K 13/006 119/72
8,506,293 B2 * 8/2013 Pond ..... A61C 1/0084 433/119
8,544,690 B2 * 10/2013 Garcia ..... B05B 11/0013 222/147
8,662,355 B2 * 3/2014 Spiegelberg ..... A47K 5/14 222/145.5
2011/0240703 A1 * 10/2011 Tobin ..... A45F 3/16 224/576
2013/0037573 A1 * 2/2013 Spiegelberg ..... A47K 5/14 222/190

* cited by examiner

HYDRATION APPARATUS AND SYSTEM

FIELD OF THE INVENTION

The present disclosure relates to novel and advantageous systems and devices for providing hydration. In particular, the present disclosure relates to novel and advantageous systems and devices for providing easily accessible oral hydration to individuals. Such individuals may include patients in a hospital, undergoing rehabilitation, or otherwise present at a care facility, or to individuals in need of or preferring easy-to-use or hands-free hydration delivery systems. More particularly, the present disclosure relates to a novel and advantageous oral hydration system having an accessible flow control valve such that a patient may access fluids without assistance.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is important that everyone maintain appropriate hydration, whether able-bodied or ill. However, the needs for certain individuals who may be ill, recovering from a medical procedure, incapacitated, and those with low mobility, are particularly in need for effective and easy-to-use hydration delivery systems. For such individuals, good hydration levels may promote recovery and overall good health, both mental and physical. In a hospital, nursing home facility, rehabilitation facility, other care facility, or for individuals receiving care from a caregiver, it is often the responsibility of a nurse or caregiver to ensure that patients are drinking enough fluids to maintain proper hydration. Patents are often provided with a pitcher and a cup to drink from, which may contain water or some other fluid or drink. However, due to mobility issues or otherwise, some patients may have difficulties reaching, pouring from a pitcher, and/or maneuvering, using, and/or grasping a cup, and thus may rely on a caregiver for assistance in drinking fluids. Others may not have particular mobility issues, but may simply prefer an easy-to-use or hands-free hydration system. Additionally, pitchers and/or cups may present a spill hazard. Caregivers may also have difficulties monitoring an amount of liquid consumed by a patient where the liquid is maintained in an open pitcher or cup. Thus, there is a need in the art for an improved apparatus and system for providing oral hydration.

BRIEF SUMMARY OF THE INVENTION

The following presents a summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a hydration system having a container, a hydration tube, and a hydration valve assembly. The container may be configured for holding a quantity of liquid. The hydration tube may extend from the container and define a flow path.

The hydration valve assembly may be arranged at an end of the hydration tube and may be configured to allow a user to access liquid held in the container. The hydration valve assembly may include a handle sized to be arranged within a user's hand, a flow control valve arranged across the flow path, and a lever configured for operating the flow control valve. In some embodiments, the flow control valve may include a pair of flexible valve walls configured to part to allow fluid to pass therebetween. The flow control valve may be arranged within a valve casing coupled to an end of the hydration tube. In some embodiments, the hydration valve assembly may further include a mouthpiece, and the flow control valve that may be arranged between the mouthpiece and the hydration tube. In some embodiments, the container and hydration tube may be thermally welded together. The container may include a flexible-walled bladder. The lever of the valve assembly may include a tooth arranged within the handle and aligned with the flow control valve, wherein the tooth is configured to cause a force on the flow control valve when the lever is pivoted inward toward the valve. The hydration valve assembly may include a cap arranged over the mouthpiece. The mouthpiece may include a flared end. Moreover, in some embodiments, the container may have a bottleneck assembly, including a neck portion surrounding an opening of the container and a cap for covering the opening, the cap configured to be removably coupled to the neck portion. The bottleneck assembly may include hanger portion that is connectable to the assembly, which may include a hook for hanging the container in one or more convenient locations.

The present disclosure, in one or more embodiments, additionally relates to a hydration valve assembly for controlling the flow of a liquid through a flow path defined by a hydration tube. The hydration valve assembly may include a handle arranged around the hydration tube that may be sized for a user's hand, a flow control valve arranged across the flow path, and a lever configured for operating the flow control valve. In some embodiments, the flow control valve may include a pair of flexible valve walls configured to part to allow fluid to pass therebetween. The flow control valve may be arranged within a valve casing, which may include a hydration tube coupling portion and a mouthpiece. The flow control valve may be arranged between the hydration tube coupling portion and the mouthpiece. In some embodiments, the mouthpiece may have a flared end. Moreover, the lever of the valve assembly may have a tooth arranged within the handle and aligned with the flow control valve, wherein the tooth is configured to cause a force on the flow control valve when the lever is pivoted inward toward the valve. The hydration valve assembly may include a cap arranged over the mouthpiece. In some embodiments, the handle may include a plurality of ribs configured to extend around the hydration tube.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to systems and devices for providing readily accessible and unassisted oral hydration to a patient or other individual. For example, hydration systems and devices of the present disclosure may be beneficial for patients or other individuals who may be ill, incapacitated, in recovery or rehabilitation, or who may otherwise benefit from a readily accessible oral hydration source. As a particular example, an oral hydration system of the present disclosure may be useable in a hospital setting or in a nursing home, rehabilitation, or other care facility. In other embodiments, an oral hydration system of the present disclosure may be used at home or for other residential or personal use not in the context of a care facility. Hydration systems of the present disclosure may generally have a hydration control valve through which a user, such as a patient, may access water or other liquids by pushing or pressing down on a lever. The hydration control valve may be, or be similar to, a pinch valve or bite valve arranged across a tube, such that by opening the valve, liquid may be permitted to flow through the tube. A hydration system of the present disclosure may allow an individual to access water, or other liquids, as needed and with limited or no assistance. Additionally, a hydration system of the present disclosure may mitigate accidental spills and reduce the potential for contaminants to enter the liquid reservoir. A hydration system of the present disclosure may further allow a nurse or caregiver to readily determine how much liquid a patient has consumed. In other embodiments, a hydration of the present disclosure may simply provide an easy-to-use or hands-free hydration experience for any individual.

Figure 1:
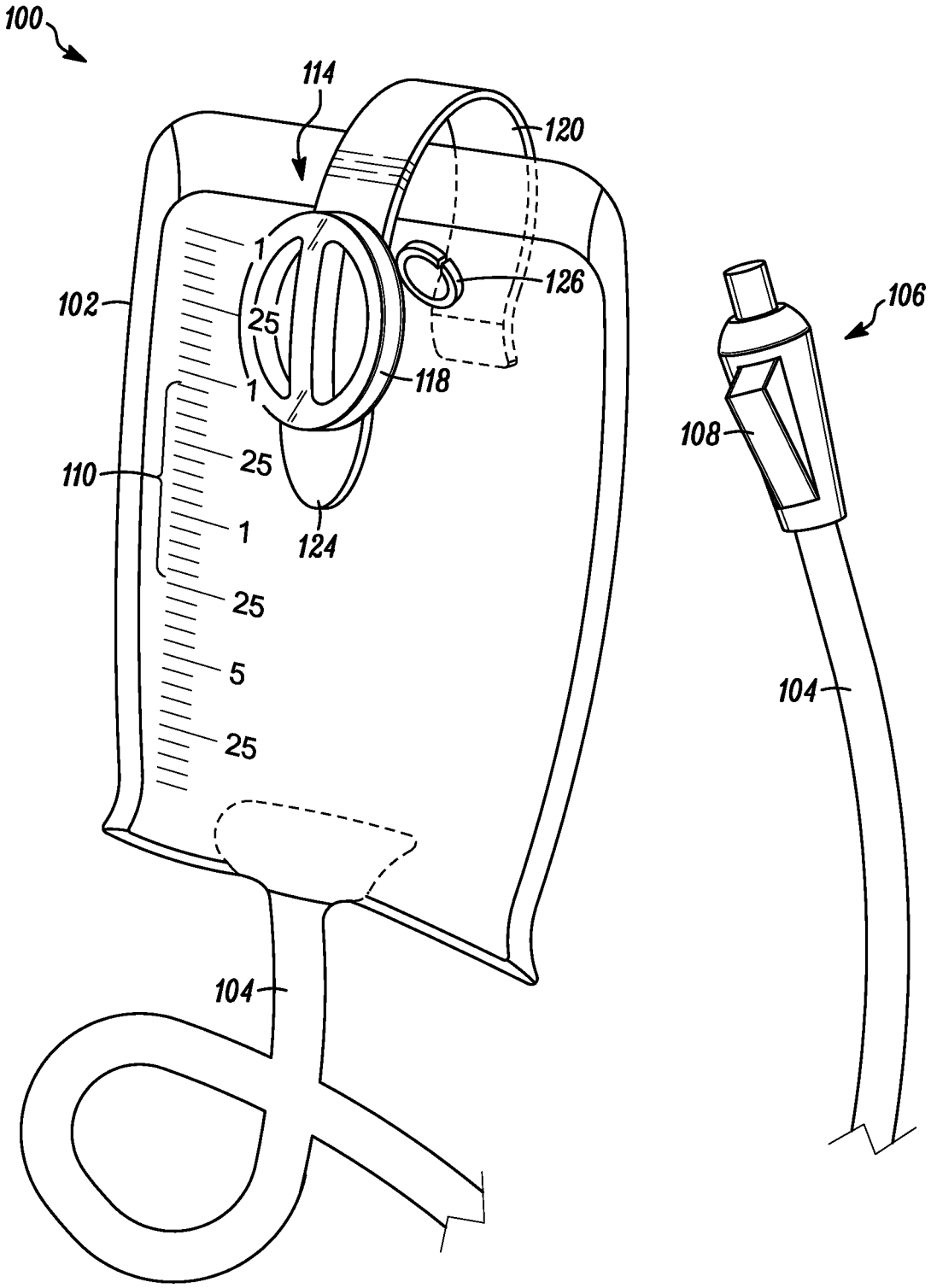
FIG. 1 is a perspective view of a hydration device of the present disclosure, according to one or more embodiments.

Turning now to FIG. 1, a hydration system 100 of the present disclosure is shown, according to one or more embodiments. The hydration system 100 may be configured to provide readily accessible oral hydration to a patient or other individual with limited, or without any, assistance from a nurse, caregiver, or other person. Additionally, the hydration system 100 may be configured to mitigate spills and avoid contaminants. The hydration system 100 may further be configured to provide a means by which a user, or a nurse or caregiver of the user, can monitor an amount of liquid consumed. As shown, the hydration system may include a container 102 coupled to a hydration tube 104 at a first end of the hydration tube. At an opposing end of the hydration tube 104, the system 100 may include a hydration valve assembly 106 with a lever 108.

Figure 2:
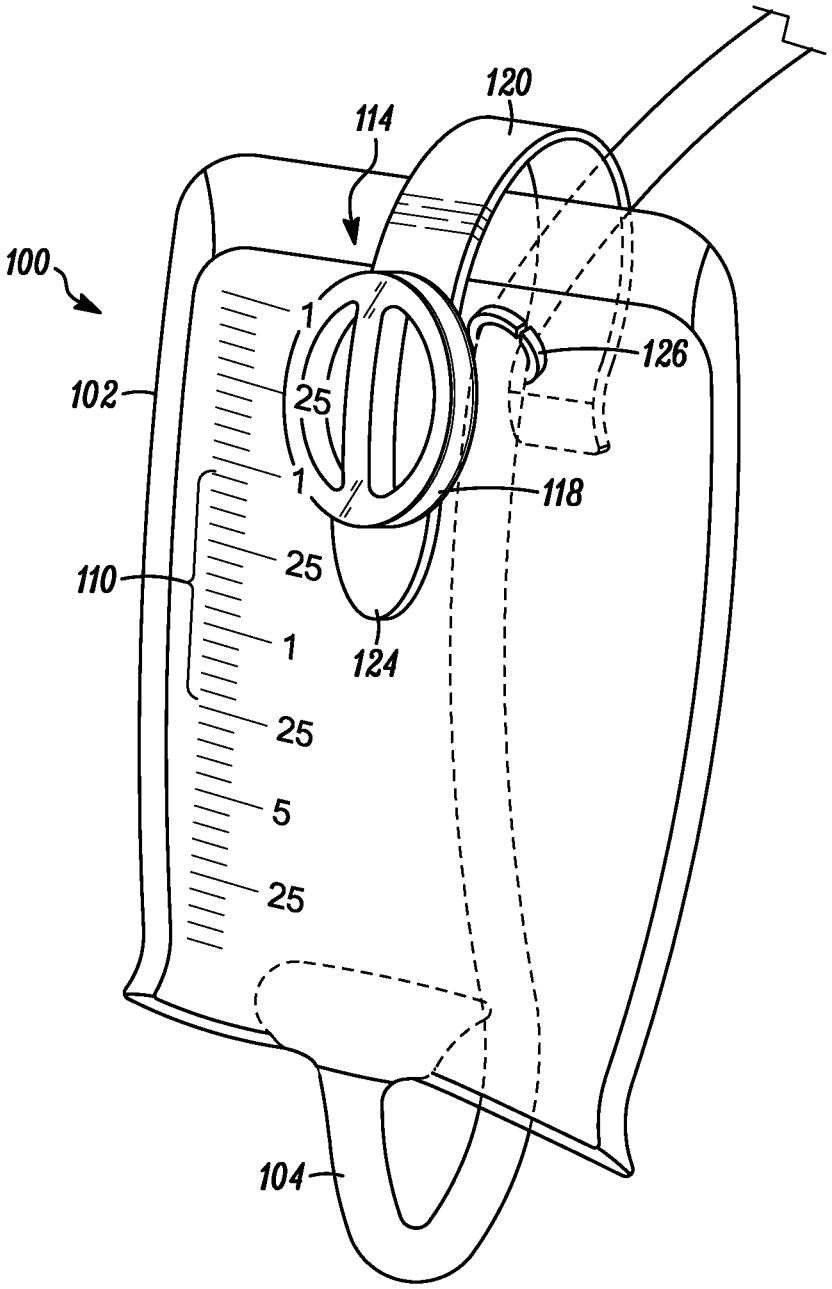
FIG. 2 is a perspective view of a bladder and a liquid container and a hydration tube of a hydration device of the present disclosure, according to one or more embodiments.
Figure 3:
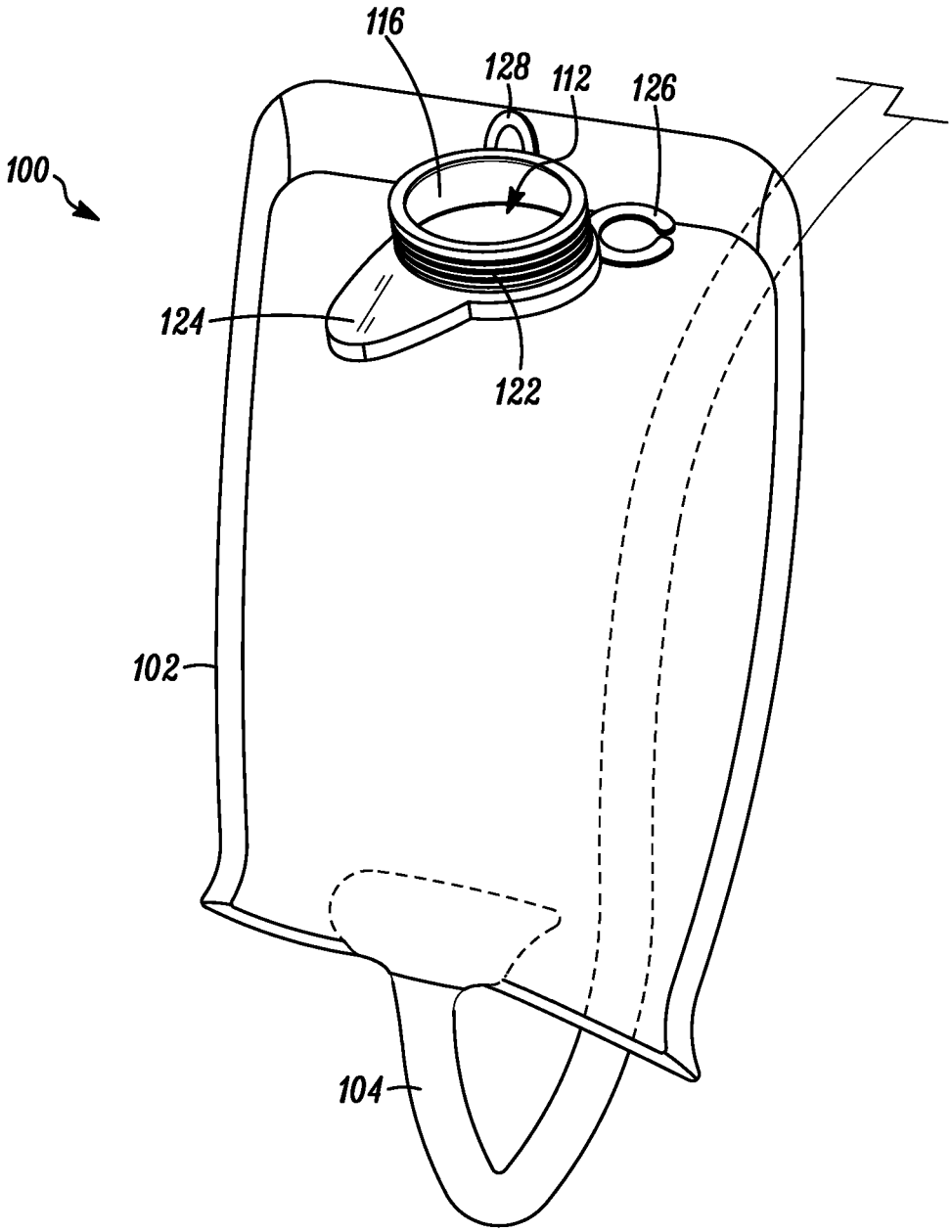
FIG. 3 is another perspective view of a liquid container and a hydration tube of a hydration device of the present disclosure, according to one or more embodiments.

The container 102 may be configured for holding a quantity of liquid, such as water or another drinkable fluid, so as to provide a source from which a user may draw oral hydration. In some embodiments, a user may consume semi-solids or other similar substance. The container 102 may further be configured to contain the liquid in a closed environment so as to mitigate spills and contamination. As shown in FIG. 1, the container 102 may be or include a bag or bladder having relatively flexible sidewalls. Such a bag or bladder may be constructed of one or more plastics, such as a low-density polyethylene (LDPE), and/or other suitable and relatively flexible materials. However, in other embodiments, the container 102 may be or include a relatively rigid container. In some embodiments, the container 102 may have a flexible bag or bladder arranged within a second container, which may be another relatively flexible container or a more rigid container. The container 102 may have any suitable volume capacity. In some embodiments, the container 102 may be configured for holding up to approximately any range of liquid between 3 liters and 250 milliliters. In some embodiments, volumes of 3 liters, 2 liters, 1.5 liters, 1 liter, 0.75, 0.5, or 0.25 liters of liquid are contemplated. In other embodiments, the container 102 may be configured for holding another suitable quantity of liquid. The container 102 may have one or more transparent or partially transparent sidewalls, such that contents within the container may be visible. In some embodiments, the container 102 may have a transparent window for viewing contents. The container 102 may have measurement markings 110, which may identify a volume or other measure of liquid within the container. In this way, a user or a user's caregiver may readily identify how much liquid the user has consumer. In still other embodiments, the container 102 may be adorned with aesthetically pleasing and customizable designs or artwork. FIGS. 2 and 3 show additional views of the container 102.

Figure 4:
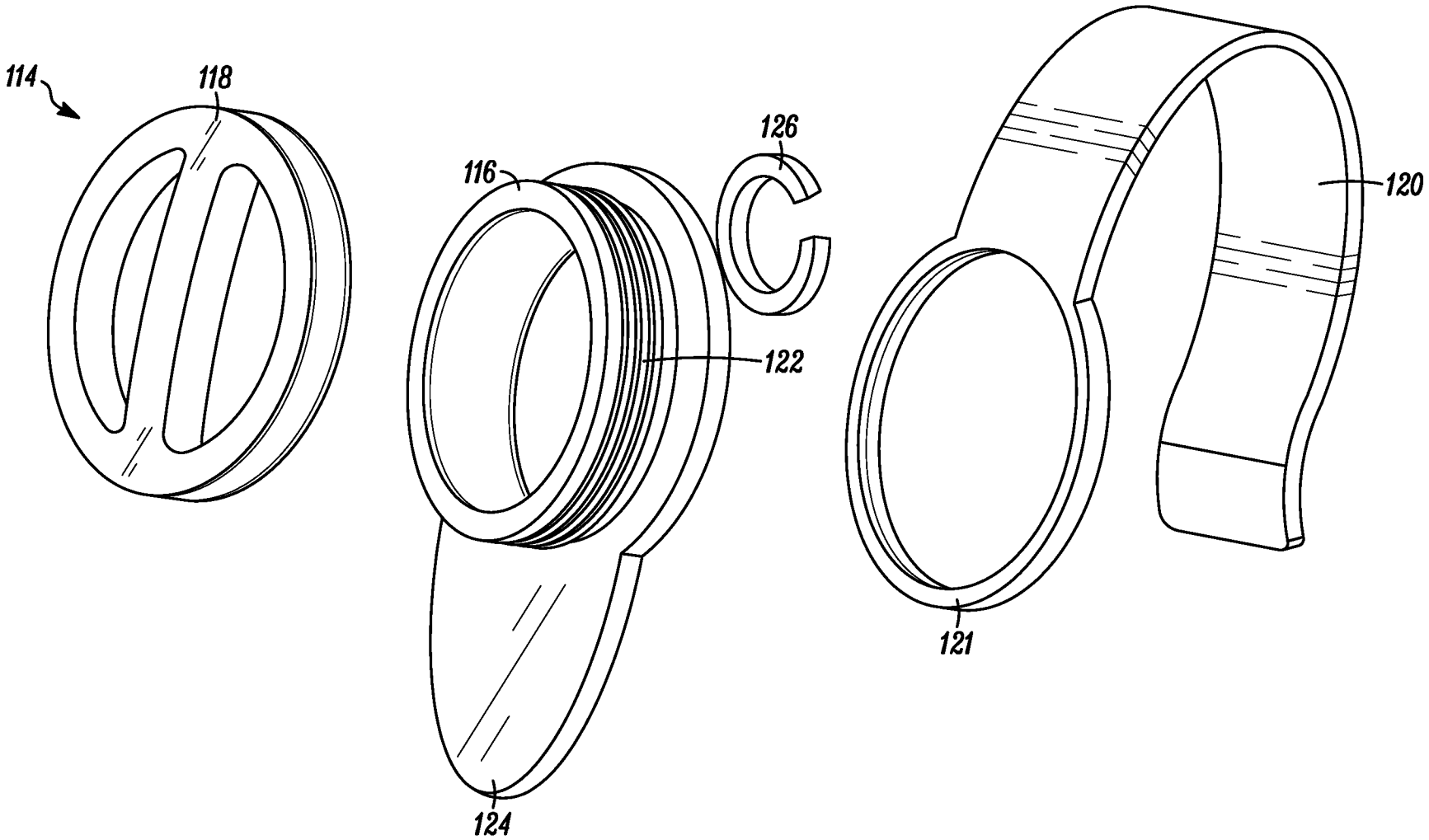
FIG. 4 is a perspective, exploded view of a bottleneck assembly of a hydration device of the present disclosure, according to one or more embodiments.

The container 102 may generally have an opening for receiving liquid. FIG. 3 shows one example of an opening 112 arranged near an end of the bag. In some embodiments, the container 102 may have a bottleneck assembly 114 positioned over the opening 112. The bottleneck assembly 114 may be configured for allowing access to the opening 112, and may further provide a covering or closure mechanism for the opening. FIG. 4 shows an exploded view of the bottleneck assembly 114, according to one or more embodiments. As shown, the bottleneck assembly 114 may include a neck portion 116 and a cap 118. In some embodiments, the bottleneck assembly 114 may additionally include a hanger portion 120.

The neck portion 116 may have a ring shape defining a circular opening, and may be arranged on an outer surface of the container 102, around the opening 112, such that the opening is accessible through the neck. The ring shape of the neck 116 may be sized so as to generally align with the opening 112 of the container 102. The neck 116 may be coupled to the container 102 using an adhesive or other suitable coupling means. The neck 116 may have a height, configured to extend perpendicular to the opening 112, or up to approximately 2 inches, or of between approximately 0.25 inches and approximately 1 inch. The neck 116 may be configured for coupling to the cap 118. For example, in some embodiments, the neck 116 may have threading 122 arranged on an outer surface thereof, and configured to engage with inner threading of the cap 118. In some embodiments, the neck 116 may further have a handle or tab 124 extending therefrom. The tab 124 may be sized and shaped to be grasped by a user's thumb and forefinger, for example. The tab 124 may be configured to allow a user to pivot or orient the bottleneck assembly 114 as needed, for example, to fill the container 102 or to attach or detach the cap 118. For example, where the container 102 comprises a relatively flexible-walled bag hanging vertically, a user may pull up on the tab 124 to orient the opening 112 generally horizontally with the opening facing upward. In some embodiments, the neck portion 116 may further have an eyelet 126 extending therefrom and configured for receiving the hydration tube 104, as shown for example in FIG. 2. The eyelet 126 may help position the hydration tube for use and/or may be used to hold the hydration tube 104 and/or valve assembly 106 during transport or when not in use.

The cap 118 may be configured to be removably coupled to the neck portion 116 to cover the opening 112, and further to allow access to the opening as needed. The cap 118 may thus be sized and shaped to fit over the opening 112. As indicated above, the cap 118 may have threading on an inner wall surface thereof configured to engage with threading 122 of the neck portion 116. In other embodiments, the cap 118 may be configured to couple to the neck portion 116 using a friction-fit mechanism, snap-fit mechanism, or other suitable coupling means.

With continued reference to FIG. 4, the hanger portion 120 may be configured to provide a means for securing the container 102 to a bed, table, chair, wheelchair, hook, IV pole or stand, or at another suitable location. The hanger portion 120 may have a hook shape configured to extend over a surface or object, such as over a headboard or sideboard of a bed, for example. The hook shape of the hanger portion 120 may further provide a handle for carrying the container 102 in some embodiments. The hanger portion 120 may extend from, or may otherwise couple to, the neck portion 116 and/or cap 118. In some embodiments, for example, the hanger portion 120 may have a circular loop 121 extending from the hook shape and configured to be positioned around the neck portion 116. The circular loop 121 attached to hanger portion 121 may further be secured to the neck portion 116 with placement of the cap 118 thereon. In addition to the hanger portion 120, in some embodiments, the container 102 may have one or more eyelets 128, which may be reinforced eyelets. As shown for example in FIG. 3, the container 102 may have a reinforced eyelet 128 arranged at or near a top of the container near the bottleneck assembly 114. In some embodiments, the one or more eyelets 128 may provide an additional or alternative means for hanging the container 102 or otherwise securing the container to a surface or object.

It is to be appreciated that in other embodiments, the container 102 may have a different closure mechanism for accessing the opening 112. Moreover, in still other embodiments, the container 102 may be configured for a single use, and may be configured without a means for refilling the container or otherwise accessing an opening of the container.

With reference to FIGS. 1-3, the hydration tube 104 may extend from the container 102 and may be configured to transport fluid from the container to a user for consumption. An opening in the container 102 may allow fluid to flow to the hydration tube 104. In some embodiments, the hydration tube 104 may couple to the container 102 at an end of the container, which may be a bottom or lowest end when the container is hung or secured via the hanger portion 120. In this way, gravity may encourage liquid in the container 102 toward the tube 104.

The hydration tube 104 may have any suitable length and diameter for transporting fluid from the container 102 to a user. For example, the hydration tube 104 may have a length of between approximately 1 foot and approximately 8 feet, or between approximately 2 feet and approximately 6 feet, or between approximately 3 feet and approximately 5 feet. In one particular embodiment, the hydration tube 104 may have a length of approximately 4 feet. The hydration tube 104 may have a diameter of approximately 0.25 inches, approximately 0.5 inches, approximately 1 inch, or approximately 1.25 inches. In other embodiments, the hydration tube 104 may have any other suitable diameter, including a larger or smaller diameter. The hydration tube 104 may be constructed of one or more plastics, such as a LDPE. In other embodiments, the hydration tube 104 may be additionally or alternatively constructed of other suitable and relatively flexible materials. In some embodiments, the hydration tube 104 may be coupled to the container 102 using thermal welding. In other embodiments, the hydration tube 104 may be coupled to the container 102 using an adhesive, epoxy, a coupler, and/or any other suitable coupling mechanisms. In still other embodiments, the hydration tube 104 and container 102 may be constructed as a single and continuous unit.

In some embodiments, the system 100 may include one or more clips configured to secure the hydration tube 104 to bedding, clothing, or another suitable location. Such clips may be used to help position the hydration tube 104 and the hydration valve assembly 106 within reach of a user. Each clip may have, for example, a ring shape configured to wrap around the hydration tube 104, and a clip portion, which may be a spring-closure clip, for example.

As indicated above, the system 100 may additionally include a hydration valve assembly 106. As shown in FIG. 1, the hydration valve assembly 106 may be arranged on an end of the hydration tube 104, such as an end opposing the end where the tube couples to the container 102. The hydration valve assembly 106 may include a flow control valve mechanism for controlling flow of liquid through the hydration tube 104. Additionally, the hydration valve assembly 106 may generally be configured to allow a user to open the valve, and thus access the liquid, with relative ease. FIGS. 5-8 show additional views of the valve assembly 106, according to at least one embodiment. With particular reference to the cross-sectional views of FIGS. 6 and 8, the valve assembly 106 may have a handle 130 configured to allow a user to hold the assembly during operation, a lever 108 configured to allow a user to operate the valve, and a flow control valve 132.

The handle 130 may be arranged around a portion of the hydration tube 104. The handle 130 may provide a housing around the valve 132, and may additionally provide a surface for a user to hold while operating the valve and/or while drinking liquid through the hydration tube 104. The handle 130 may have a generally cylindrical shape with a generally cylindrical sidewall 136 having an outer diameter configured to fit within a user's hand. In other embodiments, the handle 130 may have a square or polygonal shaped sidewall 136 in order to facilitate grip. The handle 130 may have a cylindrical central channel defining an inner diameter sized to receive the hydration tube 104. Between the sidewall 136 and the central channel, the handle 130 may have plurality of parallel ribs 134, as shown for example in FIGS. 6 and 8.

Figure 6:
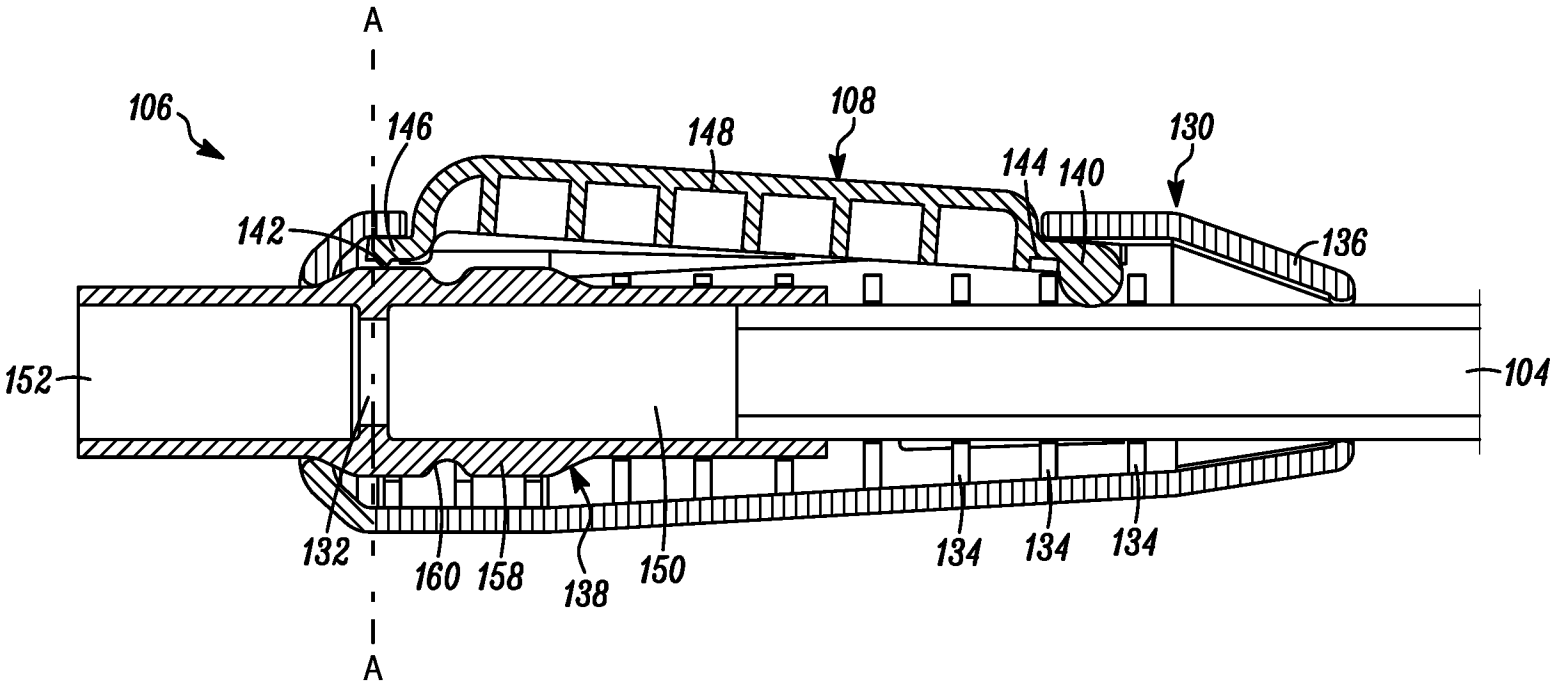
FIG. 6 is a cross-sectional view of the hydration valve assembly of FIG. 5, according to one or more embodiments.
Figure 8:
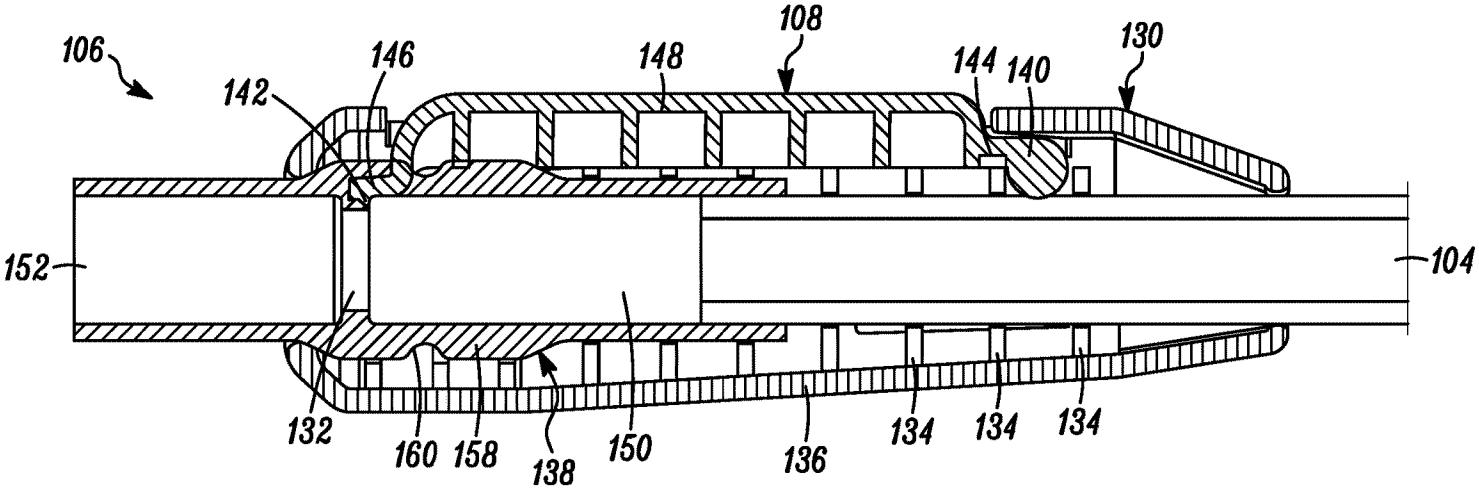
FIG. 8 is a cross-sectional view of the hydration valve assembly of FIG. 5, with the lever pushed inward to open the valve, according to one or more embodiments.

Each rib 134 may have a disk shape with a central opening configured to receive the hydration tube 104 and/or a valve casing 138. The ribs 134 may extend from an inner surface of the sidewall 136. As shown in FIGS. 6 and 8, where the lever 108 is positioned, the ribs 134 may have a notch or cutout and may thus stop short of the sidewall 136 so as to accommodate position and movement of the lever 108. The ribs 134 may be spaced along a length of the channel and may be configured to grip the hydration tube 104 and/or a valve casing 138. In other embodiments, the handle 130 may be solid between the sidewall 136 and central channel. In still other embodiments, the handle 130 may be hollow between the sidewall 136 and central channel. The handle 130 may have a length of between approximately 2 inches and approximately 8 inches, or between approximately 4 inches and approximately 6 inches. The handle 130 may be constructed of one or more relatively rigid plastics, such as a high-density polyethylene (HDPE) in some embodiments. In other embodiments, the handle 130 may be constructed of other suitable materials.

The sidewall 136 of the handle 130 may have an opening through which the lever 108 may extend. The lever 108 may have an elongate and generally rectangular shape. Additionally, the lever 108 may have a length shorter than that of the handle 130, such that first and second ends of the lever may be encased by the sidewall 136 of the handle. The lever 108 may be configured to pivot about a first end 144, so as to allow a user to press down on the lever to operate the valve 132. In particular, the lever 108 may have a pin 140 arranged at a first end 144. The pin 140 may be molded as a part of the lever 108 in some embodiments. In other embodiments, the pin 140 may couple to the lever 108 or pass through an opening of the lever configured to receive the pin. The pin 140 may be a cylindrical-shaped pin and may be positioned within the handle 130, between the sidewall 136 and the central channel. The pin 140 may be configured to pivot within the handle 130, so as to allow the lever 108 to pivot at the location of the pin. The pin 140 may further be configured such that a relatively small amount of pressure may be required to pivot the lever 108. At a second end 146 of the lever 108, opposing the first end 144, the lever may have a notch or tooth 142 configured to press against the valve 132 (or a valve casing 138) so as to open the valve. The second end 146 and tooth 142 may be positioned within the handle 130, between the sidewall 136 and the central channel. Between the first 144 and second 146 ends, the lever 108 may have an extension portion 148 configured to extend laterally from the handle 130, so as to be accessible to a user.

Figure 5:
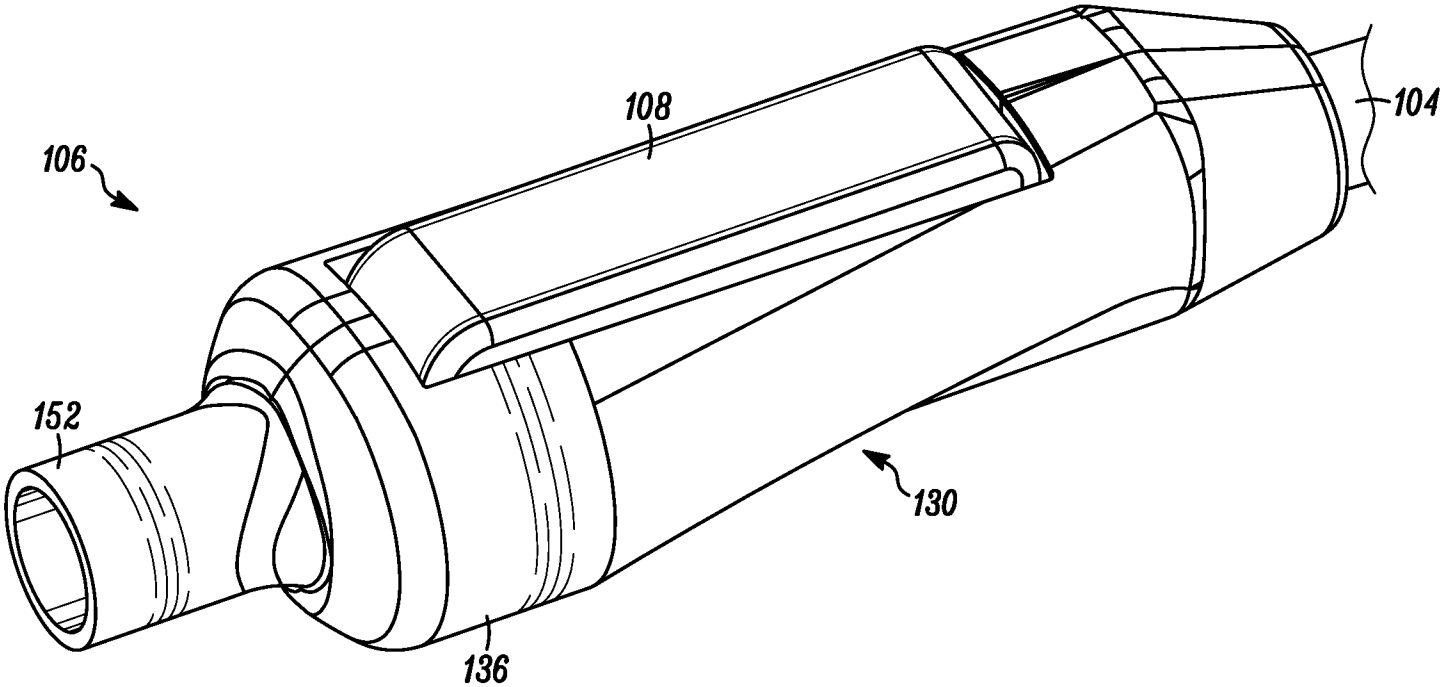
FIG. 5 is a perspective view of a hydration valve assembly of the present disclosure, according to one or more embodiments.
Figure 7:
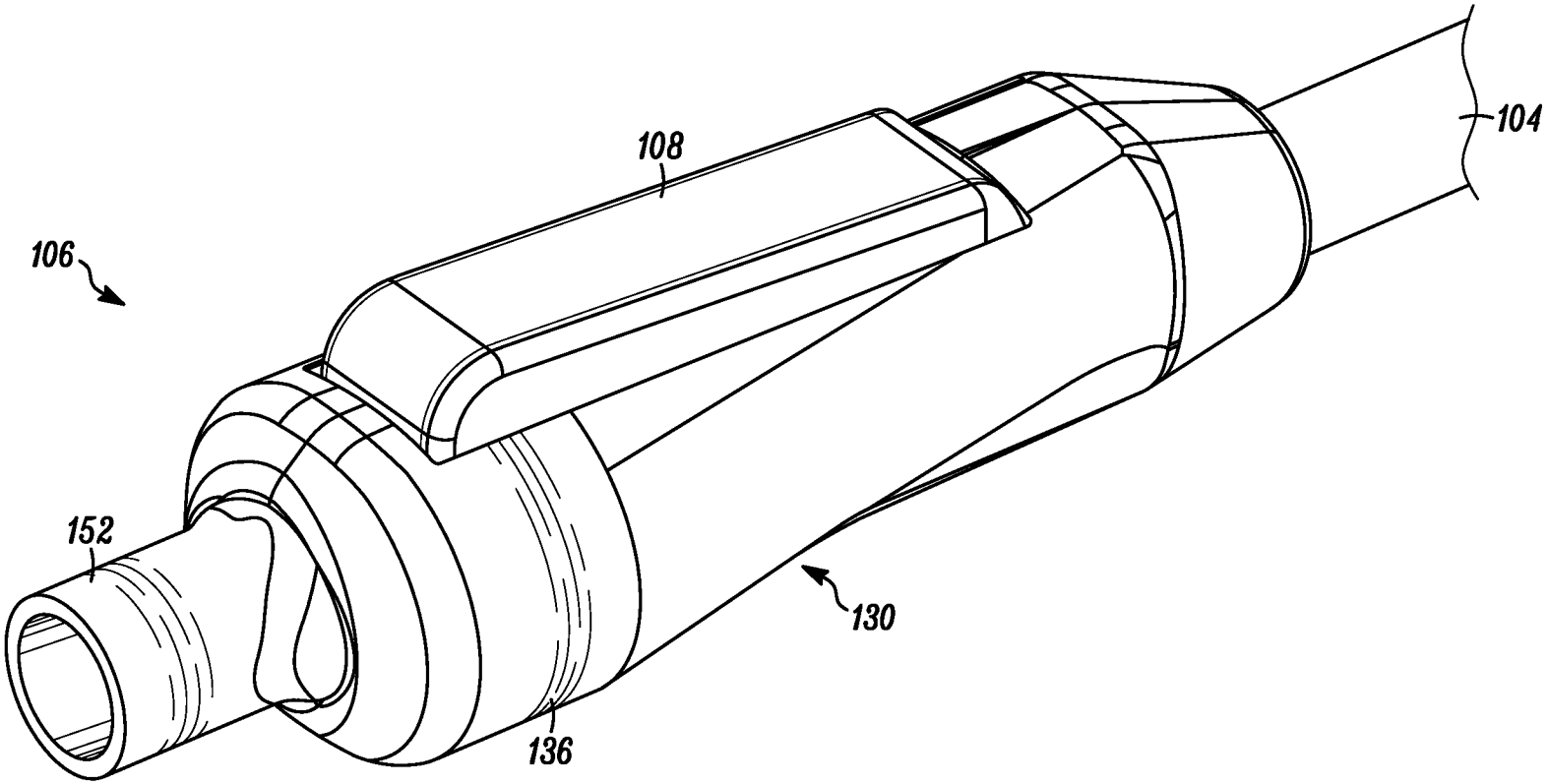
FIG. 7 is another perspective view of the hydration valve assembly of FIG. 5, with a lever pushed inward to open the valve, according to one or more embodiments.

The lever 108 may be configure to pivot, via the pin 140, between a first position and a second position. The first position may be a closed position in which the valve 132 may be closed so as to prevent liquid from passing through the valve. The first position of the lever 108 is shown in FIGS. 5 and 6. In the first position, the lever 108 may be pivoted out away from the central channel, such that the second end 146 of the lever 108 may be in contact with the sidewall 136 of the handle 130. The second position may be an open position in which the valve 132 may be open so as to allow liquid to pass through the valve. The second position of the lever 108 is shown in FIGS. 7 and 8. In the second position, the lever 108 may be pivoted inward toward the central channel such that the extension portion 148 and second end 146 may be pressed inward toward the valve 132. As the second end 146 is pushed inward toward the central channel, the tooth 142 may press against an outer surface of the valve 132 (or a valve casing 138) so as to cause the valve to open, as described in more detail below. In the second position, the ribs 134 may define a stop, preventing the lever 108 from pivoting any further toward the central channel.

Figure 9:
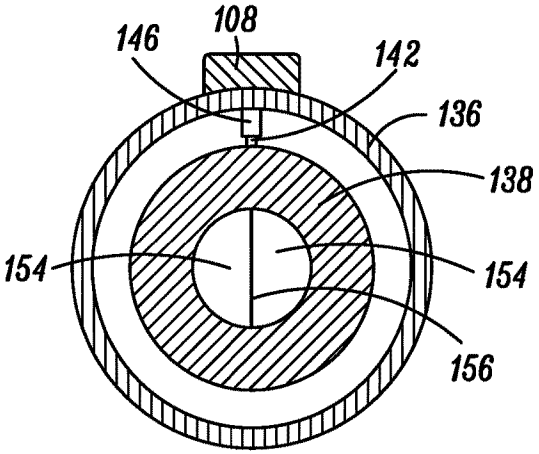
FIG. 9 is a cross-sectional view of the hydration valve assembly of FIG. 5 along line A-A, according to one or more embodiments.

The flow control valve 132 may be, or may be similar to, a pinch valve or bite valve. FIG. 9 shows a cross-sectional view of the valve assembly 106 along line A-A. As shown in FIG. 9, the flow control valve 132 may be arranged across a flow path defined by the hydration tube 104. The valve 132 may include a pair of flexible valve walls 154. Each valve wall 154 may have a semi-circular shape and may extend across approximately half the flow path. The valve walls 154 may meet at a linear slit 156 extending across the flow path. The valve walls 154 may be configured to prevent fluid from passing across the walls. In a closed position, as shown in FIG. 9, the walls 154 may generally form a seal at the slit 156 to prevent unwanted liquid flow. However, the valve 132 may be configured such that as a force is applied laterally to the valve and aligned with the slit 156, the force may cause the valve walls 154 to separate at the slit, thus opening the valve and allowing liquid to pass therethrough. As shown in FIG. 9, the valve assembly 106 may be configured such that the tooth 142 of the lever 108 is aligned with the slit 156 of the valve 132. As a user presses the lever 108 inward, the tooth 142 may press against the valve casing 138, causing a force on the valve 132 at the location of the slit 156 to open the valve.

In some embodiments, the valve 132 may be arranged within or on an end of the hydration tube 104. However, in other embodiments, as shown for example in FIGS. 6 and 8, the valve 132 may be arranged within a valve casing 138. The valve casing 138 may include a hydration tube coupling portion 150 and a mouthpiece 152, with the valve 132 arranged between the coupling portion and mouthpiece. The hydration tube coupling portion 150 may be or include a hollow sleeve sized and configured for extending over an end of the hydration tube 104. In some embodiments, the hydration tube coupling portion 150 may be secured to the hydration tube using an adhesive. The hydration coupling portion 150 may have any suitable length configured to secure the valve casing 138 to the hydration tube 104.

The mouthpiece 152 may extend outward from the central channel of the handle 130. The mouthpiece 152 may be configured to allow a user to drink liquid flowing through the open valve 132. The mouth piece 152 may be positioned beyond the valve 132. That is, the mouth piece 152 may be positioned such that the valve 132 may be between the mouthpiece and the hydration tube 104. The mouthpiece 152 may have any suitable diameter configured such that a user may position the mouthpiece between the user's lips and/or teeth to draw liquid through the mouthpiece. In some embodiments, the mouthpiece 152 may have a flared end configured to help a user hold the mouthpiece in the user's mouth and/or configured to help mitigate choking. The mouthpiece 152 may additionally have any suitable length configured to extend from the handle 130 far enough to allow a user to grasp the mouthpiece between the user's lips and/or teeth and further configured to help mitigate choking. In some embodiments, the mouthpiece 152 may have a relatively short length so as to reduce an amount of liquid that may remain present within the mouthpiece after the valve 132 closes to stop fluid flow. In some embodiments, the mouthpiece 152 may have a length of between less than 1 inch and approximately 4 inches, or between approximately 1 inch and approximately 2 inches.

The valve casing 138 may further be configured to help maintain a position of the valve 132 within the handle 130. For example, the valve casing 138 may have an outer diameter with a flared portion 158. The flared portion 158 may be arranged within the handle 130 and may have a diameter larger than an opening of the handle 130 through which the valve casing 138 extends. This may help prevent the handle from sliding down the hydration tube 104. The flared portion 158 may further have one or more notches 160. The one or more notches 160 may be configured to help grip an inner surface of the handle 130 and/or may help to maintain a position of the valve casing 138 within the handle.

The valve 132 and valve casing 138, including the hydration tube coupling portion 150 and the mouthpiece 152, may each be constructed of suitable flexible materials. In some embodiments, each component of the valve 132 and valve casing 138 may be constructed of silicon, for example. In other embodiments, the components may be constructed of other or additional suitable materials.

Figure 10:
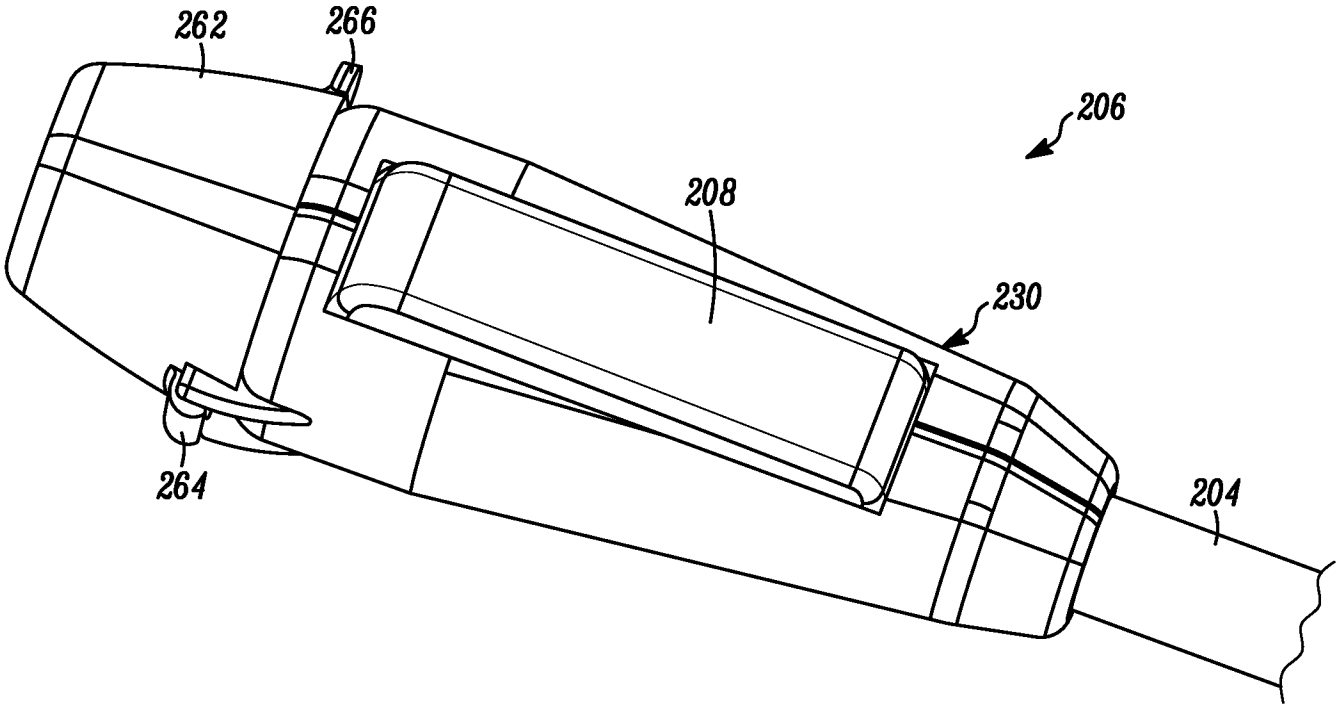
FIG. 10 is a perspective view of a hydration valve assembly of the present disclosure, with a cap closed, according to one or more embodiments.
Figure 11:
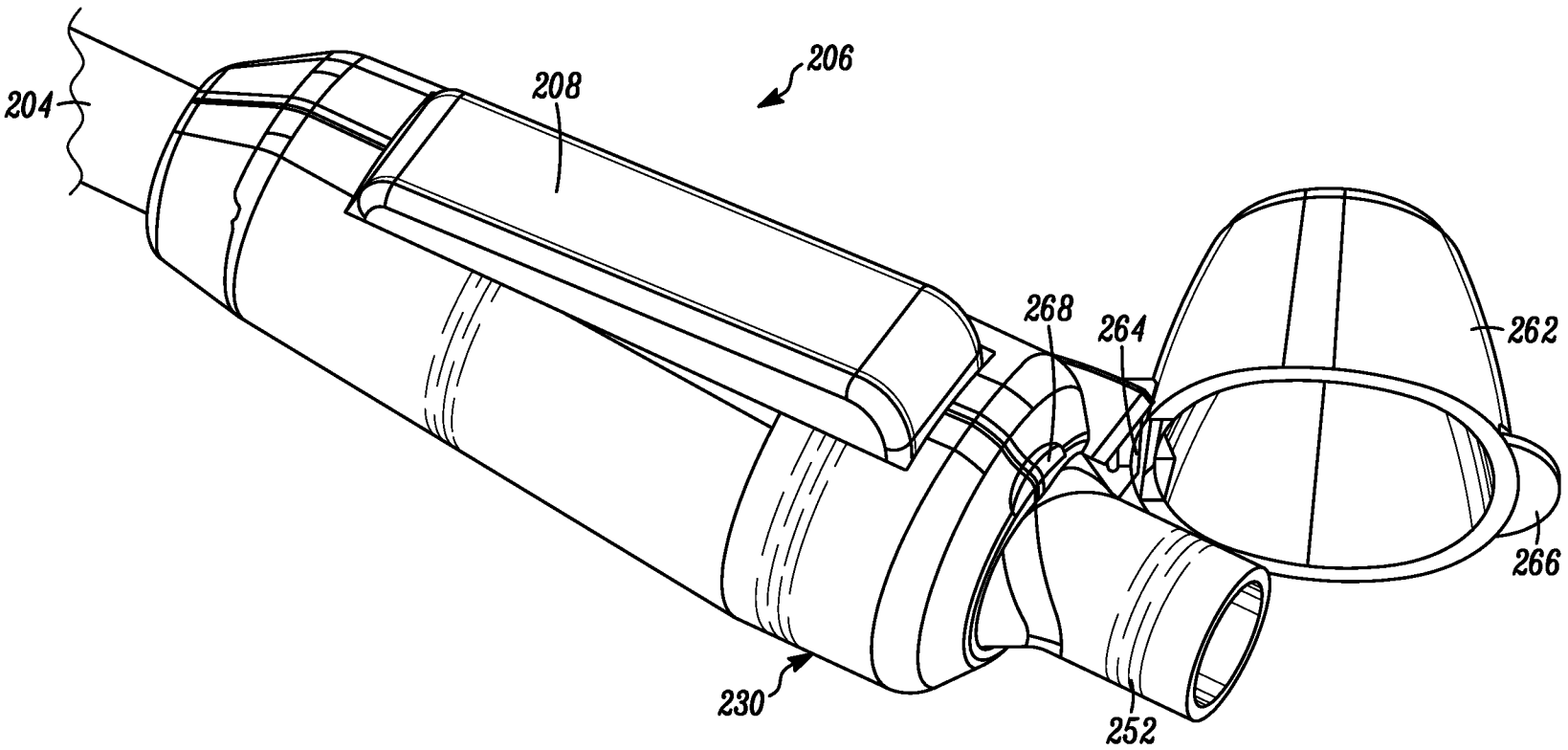
FIG. 11 is another perspective view of the hydration valve assembly of FIG. 10, with the cap open, according to one or more embodiments.

In some embodiments, the valve assembly may include a covering or cap configured to cover the mouthpiece when not in use. For example, FIGS. 10 and 11 show one embodiment of a valve assembly 206 with a handle 230 and lever 208 arranged over a hydration tube 204. As shown, the valve assembly 206 may include a cap 262 arranged over the mouthpiece 252. The cap 262 may couple to an outer surface of the handle 230. In some embodiments, the cap 262 may couple to the handle 230 via a pin 264, which may allow the cap 262 to pivot about its connection to the handle 230. The cap 262 may have a tab 266 allowing a user to easily flip the cap open or closed. In some embodiments, the handle 230 may have a ridge 268 configured to engage with an inner surface of the cap 262 to help maintain the cap in a closed position over the mouthpiece 252. It is to be appreciated that, in other embodiments, the cap 262 may couple to the valve assembly 206 using alternative coupling methods and/or may have other securing methods for securing the cap in a closed position over the mouthpiece 252 when not in use. The cap 262 may help to keep the mouthpiece 252 safe from contaminants when not in use.

In some embodiments, some or all components of a hydration system of the present disclosure may be constructed of materials configured to avoid producing a taste and/or smell so as to avoid interfering with or affecting the taste and/or smell of the liquid a user consumes through the system. Additionally, in some embodiments, all or some of the components may be constructed of food-grade and/or materials approved by one or more regulatory bodies, such as the Food and Drug Administration in the United States, the CE certification mark in the European Economic Area, or any other similar regulatory or advisory body. In some embodiments, some or all components of the hydration system may be constructed of recyclable materials. As described above, a system of the present disclosure may incorporate HDPE, LDPE, PLA, PET, PP, PC, silicon, and/or other plastics in some embodiments.

Hydration systems and devices of the present disclosure may provide an independent and accessible solution for patients or other users who may otherwise require or benefit from easy-to-use hydration systems. Hydration systems and devices of the present disclosure may be relatively easy to use, such that a user may operate the flow control valve by pressing, pushing, or holding the control valve assembly lever. In another embodiment, the lever may be replaced by a button or similar design. In this way, an individual, and particularly a patient who may have decreased mobility and/or dexterity, may be able to operate the control valve to access hydration as needed or desired. This may provide users with a sense of independence and comfort. Particularly, where a user might otherwise require assistance to drink from a cup or straw, the user may find an improved sense of independence from an ability to control hydration systems and devices of the present disclosure without assistance. Moreover, by providing a flow valve that may be controlled by a user's hand strength, rather than for example jaw strength, hydration systems and devices of the present disclosure may be useable by a wide variety of users. Systems and devices of the present disclosure may further provide a reduced choking hazard over conventional systems, such as systems in which a user drinks from a conventional straw.

Moreover, hydration systems and devices of the present disclosure may improve an individual's access to hydration. A hydration system container may be hung from any suitable location near a user so as to position the hydration valve assembly within comfortable reach. For example, a container may be hung from a bed, such as from a headboard or rail, sideboard or rail, footboard or rail, or other suitable location. Additionally, a container may be hung from a bedside table, from a wheelchair, from a chair, or from an IV pole or stand. The ability to hang the system near a user provides an improvement over other, more mobile system such as a cup and pitcher, which can be easily left out of reach. In this way, systems and devices of the present disclosure may also facilitate hydration by remaining within a user's reach.

Systems and devices of the present disclosure may be configured for relatively inexpensive manufacturing. For example, systems and devices described herein may have relatively few components, as compared with other hydration systems. Additionally, systems and devices of the present disclosure may be constructed using relatively inexpensive materials. In some embodiments, a hydration system of the present disclosure, or components thereof, may be constructed to be disposable and/or recyclable, such that a new hydration system may be provided for each patient, day, or refill, for example. However, in other embodiments, hydration systems and devices, or components thereof, may be constructed to be reusable or interchangeable.

In some embodiments, hydration systems and devices of the present disclosure may be customizable. For example, a container, hydration tube, and/or control valve assembly components may be provided in a variety of colors and/or printed patterns. Customized hydration systems, or components thereof, may further encourage hydration.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A hydration system, comprising:

a container configured for holding a quantity of liquid;

a hydration tube extending from the container and defining a flow path; and a hydration valve assembly arranged at an end of the hydration tube and configured to allow a user to access liquid held in the container, the hydration valve assembly comprising:

a handle sized to be arranged within a user's hand;

a flow control valve arranged across the flow path; and a lever configured for operating the flow control valve;

wherein the container and hydration tube are thermally welded together.

2. The hydration system of claim 1, wherein the flow control valve comprises a pair of flexible valve walls configured to part to allow fluid to pass therebetween.

3. The hydration system of claim 1, wherein the flow control valve is arranged within a valve casing coupled to an end of the hydration tube.

4. The hydration system of claim 1, wherein the hydration valve assembly further comprises a mouthpiece.

5. The hydration system of claim 4, wherein the flow control valve is arranged between the hydration tube and the mouthpiece.

6. The hydration system of claim 1, wherein the container comprises a flexible-walled bladder.

7. The hydration system of claim 1, wherein the lever comprises a tooth arranged within the handle and aligned with the flow control valve, wherein the tooth is configured to cause a force on the flow control valve when the lever is pivoted inward toward the valve.

8. The hydration system of claim 4, wherein the hydration valve assembly comprises a cap arranged over the mouthpiece.

9. The hydration system of claim 4, wherein the mouthpiece comprises a flared end.

10. A hydration system, comprising:

a container configured for holding a quantity of liquid, the container comprising a bottleneck assembly comprising:

a neck portion surrounding an opening of the container; and a cap for covering the opening, the cap configured to be removably coupled to the neck portion;

a hydration tube extending from the container and defining a flow path; and a hydration valve assembly arranged at an end of the hydration tube and configured to allow a user to access liquid held in the container, the hydration valve assembly comprising:

a handle sized to be arranged within a user's hand;

a flow control valve arranged across the flow path; and a lever configured for operating the flow control valve.

11. The hydration system of claim 10, wherein the bottleneck assembly further comprises a hanger portion comprising a hook for hanging the container.

12. A hydration valve assembly configured for controlling flow of a liquid through a flow path defined by a hydration tube, the hydration valve assembly comprising:

a handle arranged around the hydration tube and sized for a user's hand;

a flow control valve arranged across the flow path; and a lever configured for operating the flow control valve, wherein the lever comprises a tooth arranged within the handle and aligned with the flow control valve, wherein the tooth is configured to cause a force on the flow control valve when the lever is pivoted inward toward the valve.

13. The valve assembly of claim 12, wherein the flow control valve comprises a pair of flexible valve walls configured to part to allow fluid to pass therebetween.

14. The valve assembly of claim 12, wherein the flow control valve is arranged within a valve casing.

15. The valve assembly of claim 14, wherein the valve casing comprises a hydration tube coupling portion and a mouthpiece, and wherein the flow control valve is arranged between the hydration tube coupling portion and the mouthpiece.

16. The valve assembly of claim 15, wherein the mouthpiece comprises a flared end.

17. The valve assembly of claim 15, wherein the hydration valve assembly comprises a cap arranged over the mouthpiece.

18. The valve assembly of claim 12, wherein the handle comprises a plurality of ribs configured to extend around the hydration tube.

* * * * *